US006238031B1

(12) United States Patent
Weng

(10) Patent No.: US 6,238,031 B1
(45) Date of Patent: May 29, 2001

(54) SLIDING TRACK ASSEMBLY FOR DRAWERS

(76) Inventor: Kuo-Chan Weng, No. 196-6, Hsin Chuang Li, Tuku Chen, Yun Lin Hsien (TW)

( * ) Notice: Subject to any disclaimer, the term of this patent is extended or adjusted under 35 U.S.C. 154(b) by 0 days.

(21) Appl. No.: 09/512,052

(22) Filed: Feb. 24, 2000

(51) Int. Cl.[7] ..... A47B 88/00
(52) U.S. Cl. ..... 312/333; 312/334.46
(58) Field of Search ..... 312/333, 334.44, 312/334.45, 334.46; 384/21

(56) References Cited

U.S. PATENT DOCUMENTS 3,589,778 * 6/1971 Olson ..... 312/334.6 X
4,119,377 10/1978 Barber et al. .
5,316,389 5/1994 Hoffman .
5,577,821 11/1996 Chu .
5,795,044 * 8/1998 Trewhella, Jr. et al. ..... 312/333

* cited by examiner

*Primary Examiner*—Janet M. Wilkens
(74) *Attorney, Agent, or Firm*—Dougherty & Troxell

(57) ABSTRACT

Sliding track assembly for drawers, including an outer rail, an intermediate rail, an inner rail, an outer stop section and an inner engaging section. The outer rail is disposed on a cabinet. The outer stop section is disposed at one end of the intermediate rail. The inner engaging section is disposed inside the inner rail. The inner rail is disposed on a drawer. The rails are slidably assembled with each other. By means of engaging the inner engaging section with the outer stop section or detaching the inner engaging section from the outer stop section, the drawer can be easily assembled with the cabinet or separated from the cabinet.

6 Claims, 4 Drawing Sheets

SLIDING TRACK ASSEMBLY FOR DRAWERS

BACKGROUND OF THE INVENTION

The present invention relates to a sliding track assembly disposed between two articles, and more particularly to a sliding track assembly applied to drawers, file cabinets, etc.

Conventionally, two corresponding rails are disposed between a drawer and a cabinet. The two rails are slidably fitted with each other so that the drawer can be pushed and pulled within the cabinet. In addition, the two rails are disposed with corresponding stopper sections such as projecting blocks or plates so as to prevent the drawer from detaching from the cabinet and dropping down. The above rail structure always suffers great frictional force so that it is laborious to draw the drawer and a great noise will be produced when drawing the drawer. Moreover, the rail structure can hardly accurately assemble the drawer with the cabinet so that when pushing and drawing the drawer, the drawer often swings up and down and left and right. The rails are disposed with stopper sections to prevent the drawer from detaching from the cabinet and dropping. However, when it is necessary to detach the drawer or reassemble the drawer with the cabinet, only after the drawer is moved up and down to a locating point, the drawer can be detached or assembled. This is uneasy and inconvenient for a user.

A ball bearing can be disposed between the two rails as disclosed in U.S. Pat. No. 4,119,377 for facilitating the relative sliding of the drawer to the cabinet and more snugly assembling the drawer with the cabinet.

U.S. Pat. Nos. 5,316,389 and 5,577,821 disclose a sliding track assembly for drawers. The sliding track assembly includes a cabinet rail, an intermediate rail, a drawer rail, a stopper block fixed at one end of the intermediate rail and a stop lever fixed on a middle section of the drawer rail. The respective rails are slidably assembled with each other. Two small shoulder sections of the stop lever serve to engage with two small stop faces of the stopper block so as to stop the drawer from separating from the cabinet and dropping. By means of horizontally pressing the stop lever toward the drawer rail, the drawer can be easily detached from the cabinet.

The above sliding track assembly has some shortcomings as follows:

1. The stop lever and the stop faces of the stopper block have small cross-section. When drawing out the drawer, the stress is concentrated on the stop faces so that the stop faces are subject to abrasion or breakage.
2. The space between the intermediate rail and the drawer rail is quite narrow so that the stop lever lengthwise extends and is positioned substantially in parallel to the drawer rail. In order to have a sufficiently large horizontal displacement of the stop lever toward the drawer rail so as to facilitate detachment of the drawer, the stop lever is made of polymer material and the stop section is spaced from the fulcrum by a considerable distance. Accordingly, when the two small shoulder sections of the stop lever suffer a reaction force and bend due to the colliding force exerted onto the drawer which is drawn out, a component force directed to the drawer rail is produced. This makes the stop lever very easy to jump and displace toward the drawer rail. Under such circumstance, the two small shoulder sections of the stop lever can hardly engage with the two small stop faces of the stopper block and the drawer is very easy to separate from the cabinet.

SUMMARY OF THE INVENTION

It is therefore a primary object of the present invention to provide a sliding track assembly for drawers, which can truly stop the drawer when drawn out.

It is a further object of the present invention to provide the above sliding track assembly which prolongs the using life of the drawer.

According to the above objects, the sliding track assembly for drawers of the present invention includes an outer rail, an intermediate rail, an inner rail, an outer stop section and an inner engaging section. The outer rail is disposed on a cabinet. The outer stop section is disposed at one end of the intermediate rail. The inner engaging section is disposed inside the inner rail. The inner rail is disposed on a drawer.

The present invention can be best understood through the following description and accompanying drawings wherein:

DETAILED DESCRIPTION OF THE PREFERRED EMBODIMENT

Figure 1:
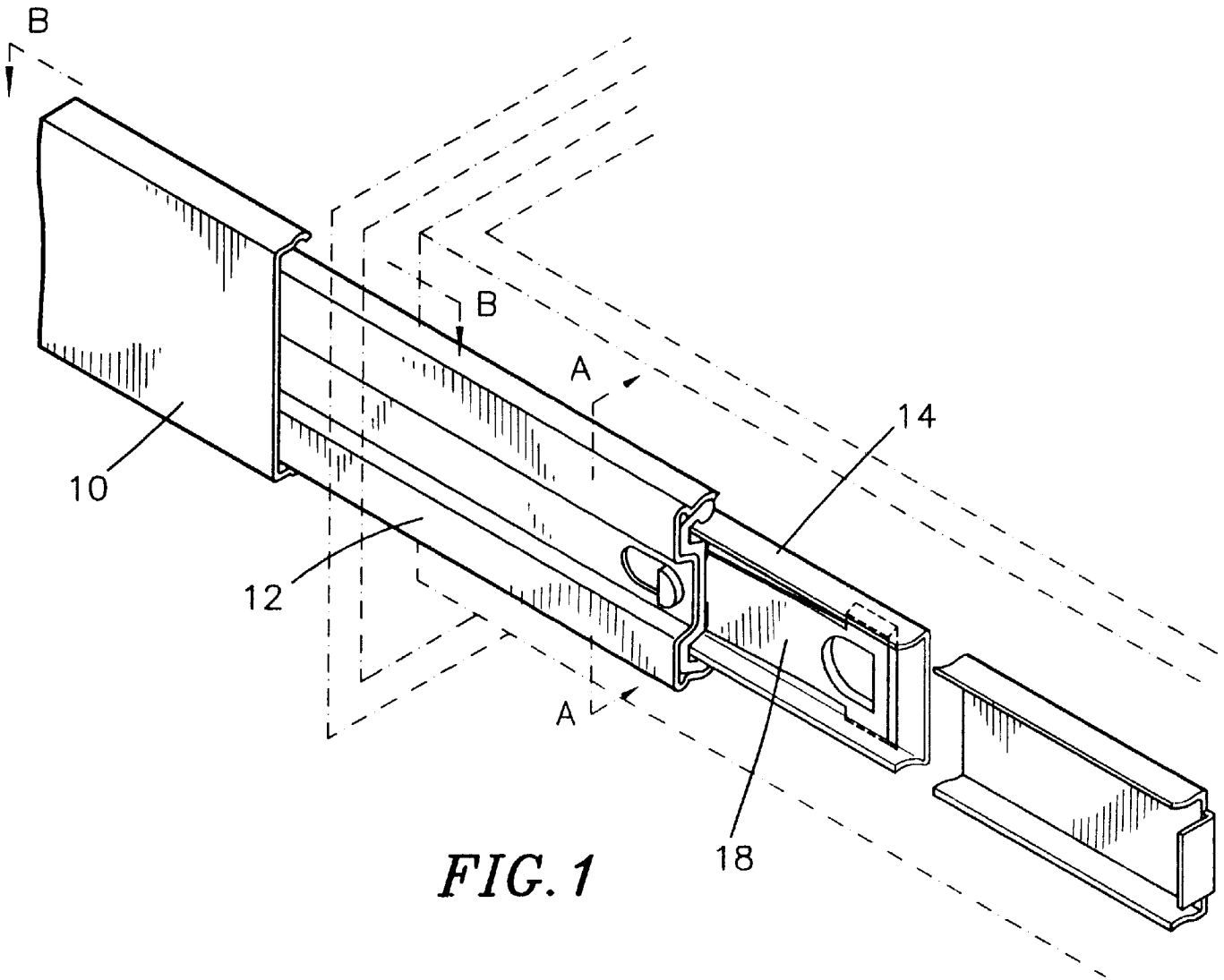
FIG. 1 is a perspective assembled view of a preferred embodiment of the present invention.
Figure 2:
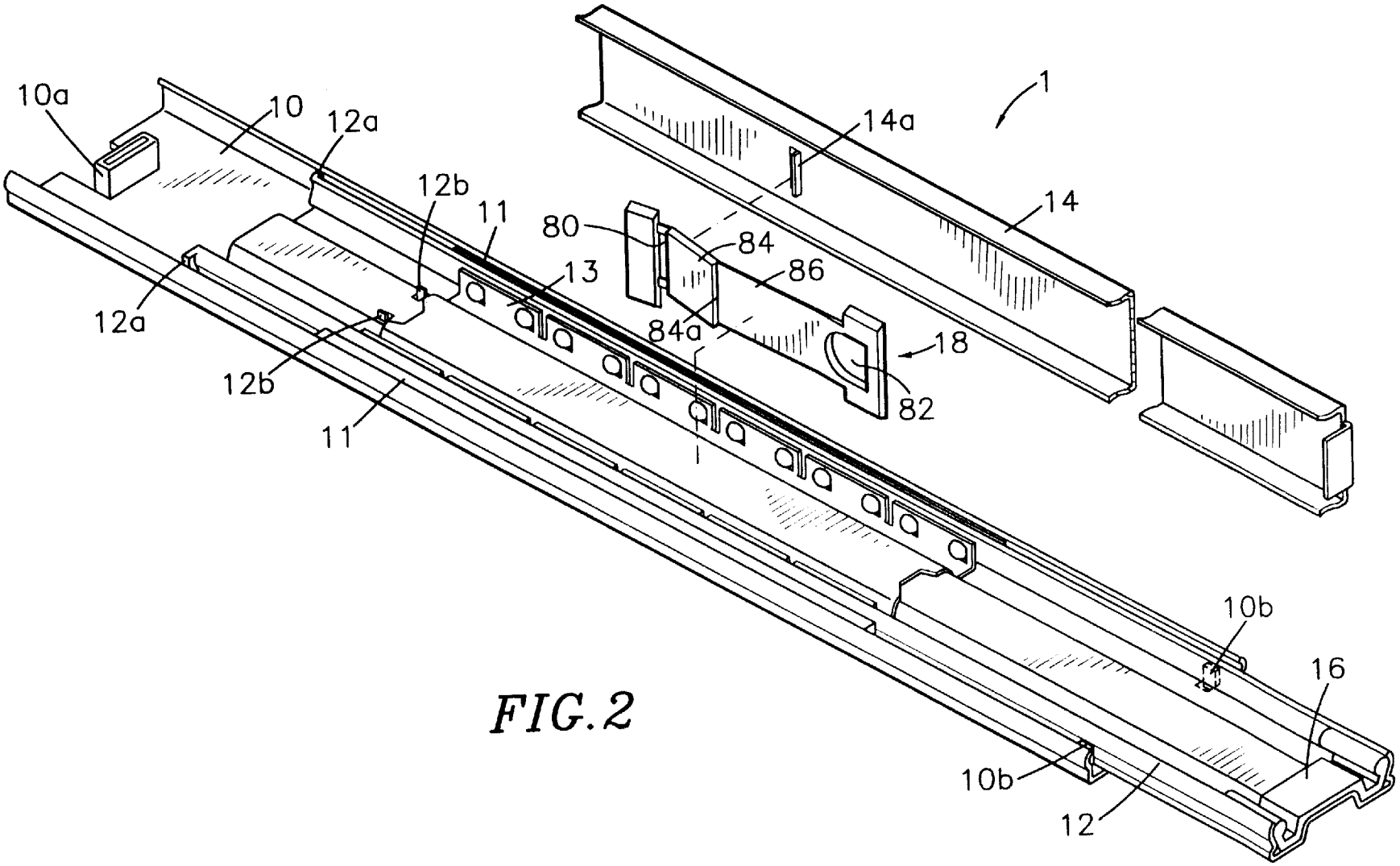
FIG. 2 is a perspective exploded view of the preferred embodiment of the present invention.
Figure 3:
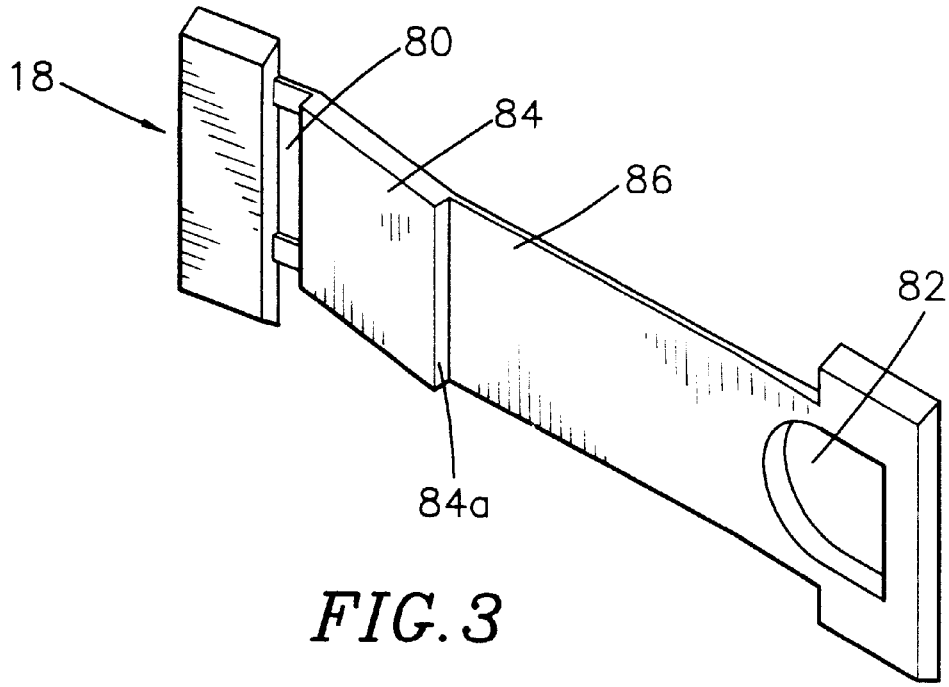
FIG. 3 is a perspective view of the inner engaging section of the preferred embodiment of the present invention.
Figure 4:
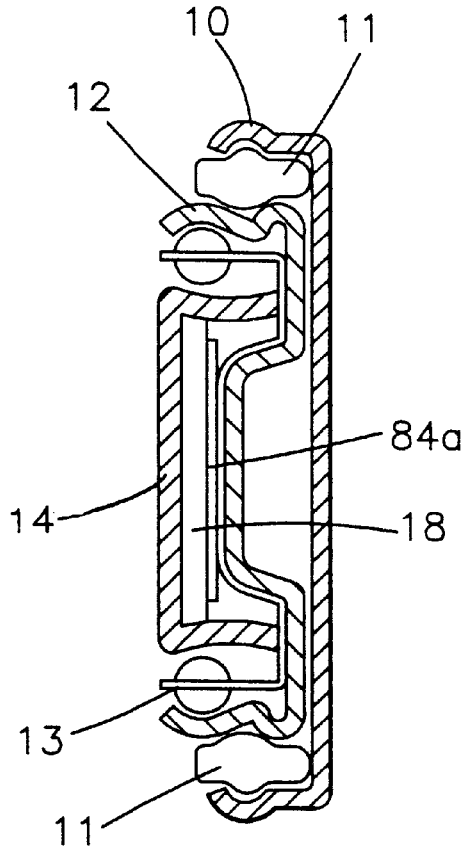
FIG. 4 is a sectional view taken along line A—A of FIG. 1.
Figure 5:
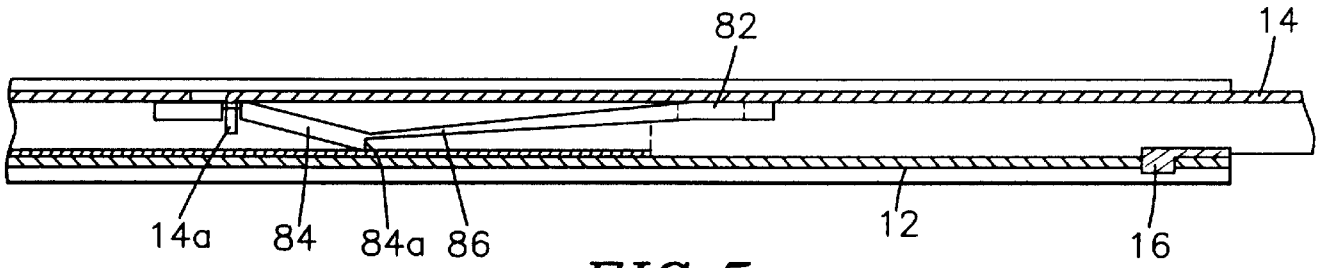
FIG. 5 is a sectional view taken along line B—B of FIG. 1, showing that the drawer is assembled with the cabinet.
Figure 6:
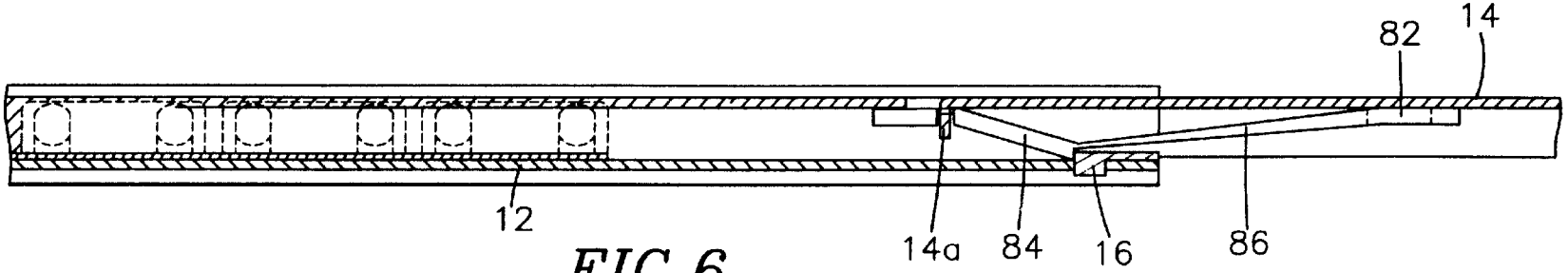
FIG. 6 is a sectional view taken along line B—B, showing that the inner engaging section is engaged with the outer stop section.
Figure 7:
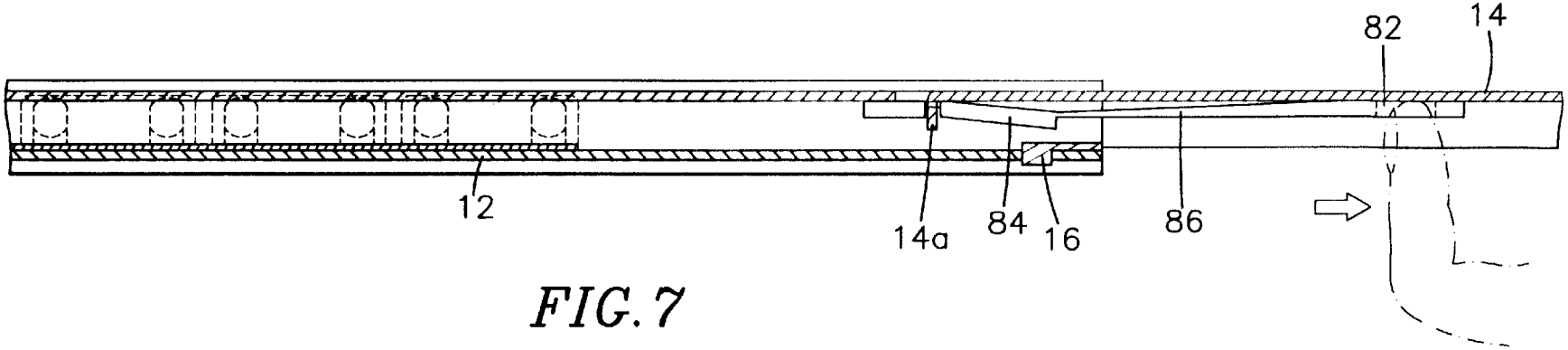
FIG. 7 is a sectional view taken along line B—B of FIG. 1, showing that the inner engaging section is not engaged with the outer stop section.

Please refer to FIGS. 1 to 7. The sliding track assembly 1 for drawers of the present invention includes an outer rail 10, an intermediate rail 12, an inner rail 14, an outer stop section 16 and an inner engaging section 18. A first ball bearing 11 is disposed between the outer rail 10 and the intermediate rail 12. A second ball bearing 13 is disposed between the intermediate rail 12 and the inner rail 14.

The outer rail 10 is a channel body having a predetermined length and a U-shaped cross-section. Two sides of the outer rail 10 are disposed with ball rails with C-shaped cross-section and spherical face. Two ends of the outer rail are respectively disposed with an outer rail stop section 10*a* and two first ball bearing stop section 10*b* for respectively stopping the intermediate rail 12 and the first ball bearing 11. The intermediate rail 12 is a channel body having a predetermined length. Two sides of the bottom face of the intermediate rail 12 have U-shaped cross-sections and the middle portion of the bottom face has a U-shaped cross-section. Two sides of the intermediate rail 12 are disposed with ball rails with C-shaped cross-section and spherical face. Two sides of one end of the intermediate rail 12 are respectively disposed with engaging sections 12*a* for engaging with the first ball bearing. The inner middle portion of the intermediate rail 12 is disposed with a second ball bearing stop section 12*b* for stopping the second ball bearing 13.

The inner rail 14 is a channel body having a predetermined length and a U-shaped cross-section. Two sides of the inner rail 14 are disposed with ball rails with C-shaped cross-section and spherical face. The inner middle portion of the bottom face of the inner rail 14 is disposed with an insertion section 14*a*.

The outer stop section 16 is disposed at an end of the intermediate rail 12 opposite to the first ball bearing engaging section 12*a,* having a cross-section with a shape substantially corresponding to that of the intermediate rail 12. The outer stop section 16 has a rectangular body with predetermined length, width and height corresponding to the U-shaped middle portion of the bottom face of the intermediate rail 12.

The inner engaging section 18 is a plastic polymer body with a predetermined length. One end of the inner engaging section 18 is disposed with an insertion hole 80 corresponding to the insertion section 14*a* for the insertion section 14*a* to insert therein. The other end thereof is formed with a latch pull hole 82. The width of the middle portion of the inner engaging section 18 is slightly smaller than the width of the inner rail 14 and has two adjoining slope faces 84, 86 swelling by a predetermined height and directed to the bottom face of the intermediate rail 12. The slope face 84 distal from the outer stop section 16 at the adjoining section has a cross-sectional area larger than that of the other slope face 86 at the adjoining section to form an inner engaging face 84*a* for engaging with the middle portion of the outer stop section 16.

In use, when the drawer is drawn out to a position where the inner engaging face 84*a* collides and engages with the outer stop section 16, by means of the two slope faces of the inner engaging section 18, the component force of the pulling force and reaction force directed to the intermediate rail 12 will be much greater than the component force directed to the inner rail 14 or even no component force directed to the inner rail 14 will be produced. Therefore, the inner engaging section 18 will not jump toward the inner rail 14 and an entirely stopping effect is achieved.

When it is desired to separate the drawer from the cabinet, a user only needs to exert a lengthwise pulling force onto the latch pull hole 82 with a finger for displacing the inner engaging face 84*a* toward the inner rail 14. At this time, it is easy to separate the drawer from the cabinet.

The sliding track assembly of the present invention has the following advantages:

1. The two slope faces of the inner engaging section 18 provide a truly stopping effect so that when drawing the drawer, the drawer is prevented from separating from the cabinet and dropping down.
2. The area of the stop cross-section is larger so that the inner engaging section 18 or the outer stop section 16 is not subject to wearing or breakage and the using life is prolonged.

The angle of the bending section of the bottom face of the inner rail 14 and the inner edges of two lateral sides of the inner rail 14 can be an acute angle. In addition, the cross-section of two ends of the inner engaging section 18 can have a trapezoid shape in which the length of the lower side corresponds to the width of inner edge of bottom face of the inner rail 14 and is larger than the length of the upper side. The slope of the lateral sides of the trapezoid corresponds to the acute angle, whereby when assembling the inner engaging section 18 and the inner rail 14, a user only needs to downward press two ends of the inner engaging section 18 toward the bottom face of the inner rail 14 for easily slidably inserting the inner engaging section 18 into the inner rail 14 without easy detachment.

The above embodiment is only used to illustrate the present invention, not intended to limit the scope thereof. Many modifications of the above embodiment can be made without departing from the spirit of the present invention.

What is claimed is:

1. Sliding track assembly for drawers, comprising:

an outer rail having a predetermined length;

an intermediate rail having a predetermined length;

an inner rail having a predetermined length;

an outer stop section disposed at an outer end of the intermediate rail, having a cross-sectional stop face;

an inner engaging section which is a plastic polymer body having a predetermined length, one end of the inner engaging section being fixed at a predetermined portion of the middle of the inner rail, the other end thereof being formed with a hole, a middle portion of the inner engaging section being formed by two slope faces directed to the intermediate rail and adjoining each other, the slope face distal from the outer stop section at the adjoining section has a cross-sectional area larger than that of the other slope face at the adjoining section to form an inner engaging face for engaging with the stop face of the outer stop section.

2. Sliding track assembly for drawers as claimed in claim 1, wherein the cross-section of the engaging face of the inner engaging section and the cross-section of the stop face of the outer stop section are rectangular.

3. Sliding track assembly for drawers as claimed in claim 1, wherein the angle of the bending section of the bottom face of the inner rail and the inner edges of two lateral sides of the inner rail is an acute angle and the cross-section of two ends of the inner engaging section has a trapezoid shape in which the length of the lower side corresponds to the width of inner edge of bottom face of the inner rail and is larger than the length of the upper side, the slope of the lateral sides of the trapezoid corresponding to the acute angle.

4. Sliding track assembly for drawers, comprising:

an outer rail having a predetermined length and a spherical face rail;

an intermediate rail having a predetermined length and a spherical face rail;

an inner rail having a predetermined length and a spherical face rail;

a first ball bearing disposed between the spherical face rails of the outer rail and the intermediate rail;

a second ball bearing disposed between the spherical face rails of the intermediate rail and the inner rail;

an outer rail stop section disposed at one end of the outer rail for stopping the intermediate rail;

a first ball bearing stop section disposed at the other end of the outer rail for stopping the first ball bearing;

two engaging sections disposed on two sides of one end of the intermediate rail for engaging with the first ball bearing;

a second ball bearing stop section disposed at an inner middle portion of the bottom face of the intermediate rail for stopping the second ball bearing;

an outer stop section disposed at an outer end of the intermediate rail, having a cross-sectional stop face; and an inner engaging section which is a plastic polymer body having a predetermined length, one end of the inner engaging section being fixed at a predetermined portion of the middle of the inner rail, the other end thereof being formed with a hole, a middle portion of the inner engaging section being formed by two slope faces directed to the intermediate rail and adjoining each other, the slope face distal from the outer stop section at the adjoining section has a cross-sectional area larger than that of the other slope face at the adjoining section to form an inner engaging face for engaging with the stop face of the outer stop section.

5. Sliding track assembly for drawers as claimed in claim 4, wherein the cross-section of the engaging face of the inner engaging section and the cross-section of the stop face of the outer stop section are rectangular.

6. Sliding track assembly for drawers as claimed in claim 4, wherein the angle of the bending section of the bottom face of the inner rail and the inner edges of two lateral sides of the inner rail is an acute angle and the cross-section of two ends of the inner engaging section has a trapezoid shape in which the length of the lower side corresponds to the width of inner edge of bottom face of the inner rail and is larger than the length of the upper side, the slope of the lateral sides of the trapezoid corresponding to the acute angle.

* * * * *